US007119823B2

(12) United States Patent
Takahashi et al.

(10) Patent No.: US 7,119,823 B2
(45) Date of Patent: Oct. 10, 2006

(54) RETRANSFER PRINTING METHOD AND PRINTING APPARATUS THEREOF

(75) Inventors: Toshinori Takahashi, Kawasaki (JP); Keiji Ihara, Sagamihara (JP)

(73) Assignee: Victor Company of Japan, Ltd., Yokohama (JP)

( * ) Notice: Subject to any disclaimer, the term of this patent is extended or adjusted under 35 U.S.C. 154(b) by 138 days.

(21) Appl. No.: 10/823,641

(22) Filed: Apr. 14, 2004

(65) Prior Publication Data

US 2004/0207714 A1 Oct. 21, 2004

(30) Foreign Application Priority Data

Apr. 17, 2003 (JP) ..... 2003-112538

(51) Int. Cl.
*B41J 2/325* (2006.01)

(52) U.S. Cl. ..... 347/213

(58) Field of Classification Search ..... None
See application file for complete search history.

(56) References Cited

U.S. PATENT DOCUMENTS 5,447,902 A * 9/1995 Imai et al. ..... 503/227
6,803,936 B1 * 10/2004 Odaka et al. ..... 347/213
6,894,710 B1 * 5/2005 Suzuki et al. ..... 347/213
6,909,446 B1 * 6/2005 Araki et al. ..... 347/213

FOREIGN PATENT DOCUMENTS

| | | |
|---|---|---|
| DE | 2 286 559 A | 8/1995 |
| EP | 0 585 852 A | 3/1994 |
| JP | 11 001010 | 7/2000 |
| JP | 2000 190636 A | 7/2000 |
| JP | 07 266589 A | 10/2005 |

* cited by examiner

*Primary Examiner*—K. Feggins
(74) *Attorney, Agent, or Firm*—Connolly Bove Lodge & Hutz LLP

(57) ABSTRACT

In a process of peeling off a transfer layer of an intermediate transfer film, an amount of energy, which is supplied to a thermal head 3 so as to heat the thermal head 3, is changed in accordance with a location of the thermal head 3 in a peeling area 71P and its neighboring area. The amount of energy is designated to be maximum energy E1 when the thermal head 3 is positioned in the neighborhood of a boundary area of the peeling area 71P while the thermal head 3 relatively moves from outside the peeling area 71P, that is, a non-peeling area 71NP to inside the peeling area 71P. In a case that the thermal head 3 is positioned in the non-peeling area 71NP or outside the peeling area 71P, a certain amount of energy is supplied to the thermal head 3 so as to maintain a temperature T of the thermal head 3 at a temperature of less than a predetermined temperature PA while heating the thermal head 3.

11 Claims, 10 Drawing Sheets

RETRANSFER PRINTING METHOD AND PRINTING APPARATUS THEREOF

BACKGROUND OF THE INVENTION

1. Field of the Invention

The present invention relates to a retransfer printing met-hod and a printing apparatus thereof, wherein an ink image is transferred from an ink ribbon to an intermediate transfer film, and then a transfer layer formed on the intermediate transfer film through the transfer process is re-transferred to a printing medium to be printed.

2. Description of the Related Art

A so-called retransfer printing apparatus has been commonly known until now. The retransfer printing apparatus prints such that an ink image is once transferred from an ink ribbon to an intermediate printing film, and then the ink image is re-transferred from the intermediate transfer film to a surface of a printing medium such as a card and a sheet. There exists a card printer,as one example of such a retransfer printing apparatus.

In the case of the retransfer printing method, by using an ink ribbon continuously formed with ink areas of each color such as yellow, magenta, cyan and black that are sequentially arranged on a belt-shaped sheet, heating a thermal head in response to a picture image transfers ink from each ink area to an intermediate transfer film and forms the picture image on the intermediate transfer film. Then the picture image formed on the intermediate transfer film is re-transferred to a printing medium by applying heat and pressure of a heat roller and finally printed on the printing medium.

In the case that a printing medium is in a shape of a bankbook or a card, there provided an area for an IC chip, a magnetic stripe or writing a signature on the surface of the printing medium.

If any membrane is adhered over the area provided as mentioned above while re-transferring, there exist problems. In the case that the area is for an IC chip, terminals for external connection of the IC chip are made poor contact. In the case that the area is a magnetic stripe area, poor contact with a magnetic head occurs. In the case that the area is for signature, ink of a ball point pen or like hardly fixes permanently in the area.

In order to solve the above-mentioned problems, by designating such an area to be a non-transfer area so as not to be transferred while re-transferring, various countermeasures have been studied such that a shape of a heat roller was designed and an area for not forming an ink image corresponding to a non-transfer area was provided on an intermediate transfer film. However, in any cases, these countermeasures resulted in increasing cost drastically because a special component varied by each picture image to be printed was essential to be exclusively prepared.

With respect to these problems, the Japanese Patent Application Laid-open Publication No. 7-266589/1995 discloses the method that is capable of forming a desired non-transfer area without using a special component.

The method disclosed in the Japanese Patent Application Laid-open Publication No. 7-266589/1995 is as follows: a peeling layer (adhesive layer) is continuously provided on each ink layer of an ink ribbon so as to peel off ink that is transferred on an intermediate transfer film, and at the end of a transfer process of one image, ink that is previously transferred on the intermediate transfer film is peeled off by heating an area corresponding to a non-transfer area of the peeling layer by means of a thermal head, and then the non-transfer area is formed on the intermediate transfer film.

Consequently, a non-transfer area is enabled to form on an intermediate transfer film by designating an arbitrary range.

In the meantime, whether or not a peeling layer enables to peel off ink transferred on an intermediate transfer film depends upon whether or not a desired range of the peeling layer enables to be heated up to a predetermined temperature or more.

However, when heating a thermal head, a gradient of rising temperature of the thermal head is gradual and there exists scatter in a rising temperature characteristic of each modular head of the thermal head, wherein modular heads are arranged in line and in parallel with each other. Consequently, a boundary to be a non-transfer area is hardly designated, and resulting in a problem of peeling off ink defectively.

Further, such defective peeling off was particularly remarkable at a border where a relative position of a thermal head on an ink ribbon moved from a transfer area to a non-transfer area when transferring.

SUMMARY OF THE INVENTION

Accordingly, in consideration of the above-mentioned problems of the prior art, an object of the present invention is to provide a retransfer printing method and a printing apparatus of the retransfer printing method, which makes a boundary between a peeling area and a non-peeling area on an intermediate transfer film clear and prevents the peeling area from growing a not peeled off portion, and further makes a boundary between a retransfer area and a non-retransfer area on a printing medium clear and prevents the non-retransfer area from being transferred.

According to an aspect of the present invention, there provided a retransfer printing method comprising steps of: overlapping an ink ribbon in a belt shape having both layers of a transfer ink layer containing transfer-ink and a peel functional layer thereon, on an intermediate transfer film in a belt shape having a transfer layer thereon so as to face the transfer ink layer toward the transfer layer; moving the ink ribbon and the intermediate transfer film together to a longitudinal direction while pressing a thermal head against the back side of the ink ribbon overlapped on the intermediate transfer film; transferring the transfer-ink to the transfer layer by heating the thermal head corresponding to an image to be printed so as to form the image composed of the transfer-ink on the transfer layer; adhering a part of the transfer layer corresponding to a peeling area previously designated within an area of the image to the peel functional layer by heating the thermal head corresponding to the peeling area over a predetermined temperature; peeling off the part of the transfer layer adhered to the peel functional layer from the intermediate transfer film; and re-transferring the transfer layer to the printing medium by the thermal transfer method, and resulting in printing the image on the printing medium, the retransfer printing method is further characterized in that an amount of energy, which is supplied to the thermal head so as -to heat the thermal head, is changed in accordance with a location of the thermal head in the peeling area and its neighboring area during the step of peeling.

According to another aspect of the present invention, there provided a printing apparatus of a retransfer printing method comprising steps of: overlapping an ink ribbon in a belt shape having both layers of a transfer ink layer containing transfer-ink and a peel functional layer thereon, on an intermediate transfer film in a belt shape having a transfer layer thereon so as to face the transfer ink layer toward the transfer layer; moving the ink ribbon and the intermediate transfer film together to a longitudinal direction while pressing a thermal head against the back side of the ink ribbon overlapped on the intermediate transfer film; transferring the transfer-ink to the transfer layer by heating the thermal head corresponding to an image to be printed so as to form the image composed of the transfer-ink on the transfer layer; adhering a part of the transfer layer corresponding to a peeling area previously designated within an area of the image to the peel functional layer by heating the thermal head corresponding to the peeling area over a predetermined temperature; peeling off the part of the transfer layer adhered to the peel functional layer from the intermediate transfer film; and re-transferring the transfer layer to the printing medium by the thermal transfer method, and resulting in printing the image on the printing medium, wherein an amount of energy, which is supplied to the thermal head so as to heat the thermal head, is changed in accordance with a location of the thermal head in the peeling area and its neighboring area during the step of peeling, the printing apparatus comprising a control section for controlling the amount of energy supplied to the thermal head by a predetermined control pattern during the step of peeling.

Other object and further features of the present invention will be apparent from the following detailed description when read in conjunction with the accompanying drawings.

BRIEF DESCRIPTION OF DRAWINGS

FIG. 2(*b*) is a perspective view of the intermediate transfer film shown in FIG. 2(*a*) exhibiting a peeling off process.

FIG. 2(*c*) is a perspective view of the intermediate transfer film shown in FIG. 2(*b*) showing a process of re-transferring a peeling area to a printing medium in a card shape.

FIG. 2(*d*) is a perspective view of the printing medium viewed from an arrow "U" direction in FIG. 2(*c*), wherein the peeling area shown in FIG. 2(*c*) is re-transferred to the printing medium.

FIG. 3(*b*) shows a first energy control pattern applied to a thermal head of the printing apparatus so as to form the peeling area shown in FIG. 3(*a*) according to the first embodiment of the present invention.

FIG. 6(*b*) shows an energy control pattern according to the comparative example.

FIG. 7(*b*) shows a third energy control pattern applied to the thermal head of the printing apparatus so as to form the peeling area shown in FIG. 7(*a*) according to the second embodiment of the present invention.

DETAILED DESCRIPTION OF THE PREFERRED EMBODIMENTS

Figure 1:
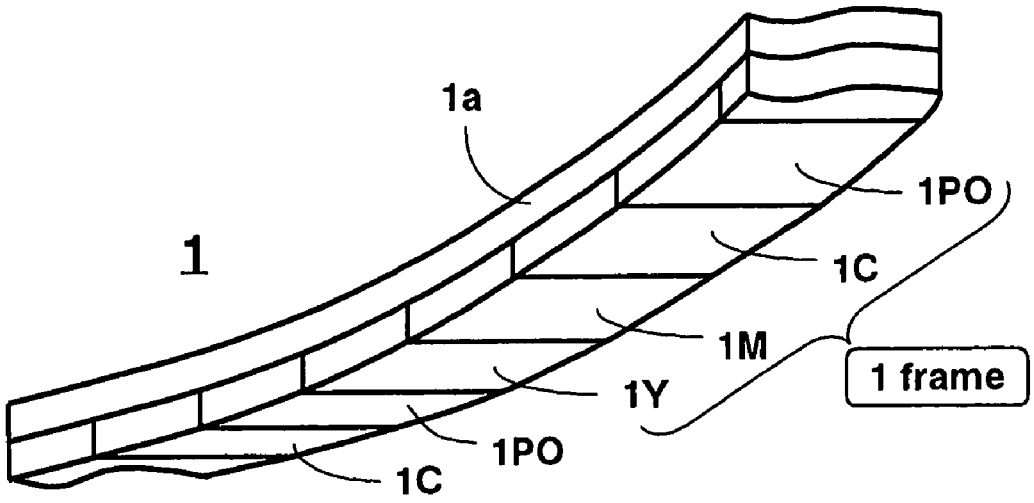
FIG. 1 is a perspective view of an ink ribbon used in a printing apparatus of a retransfer printing method according to embodiments of the present invention.
Figure 2A:
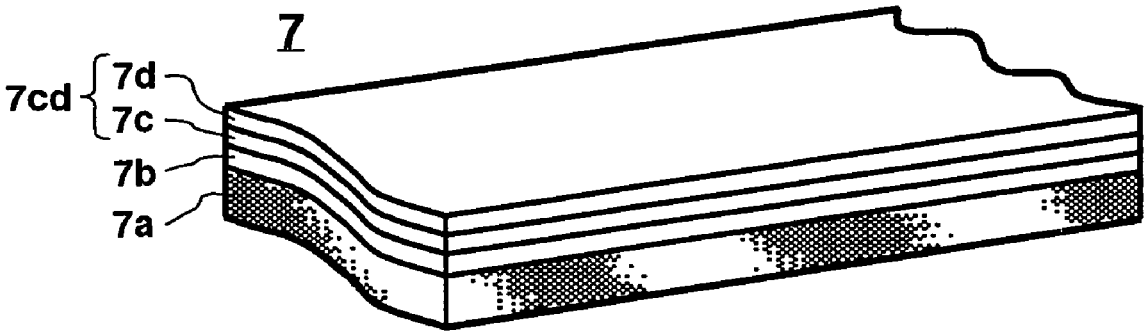
FIG. 2(*a*) is a perspective view of an intermediate transfer film used in the printing apparatus of the retransfer printing method according to the embodiments of the present invention.
Figure 2B:
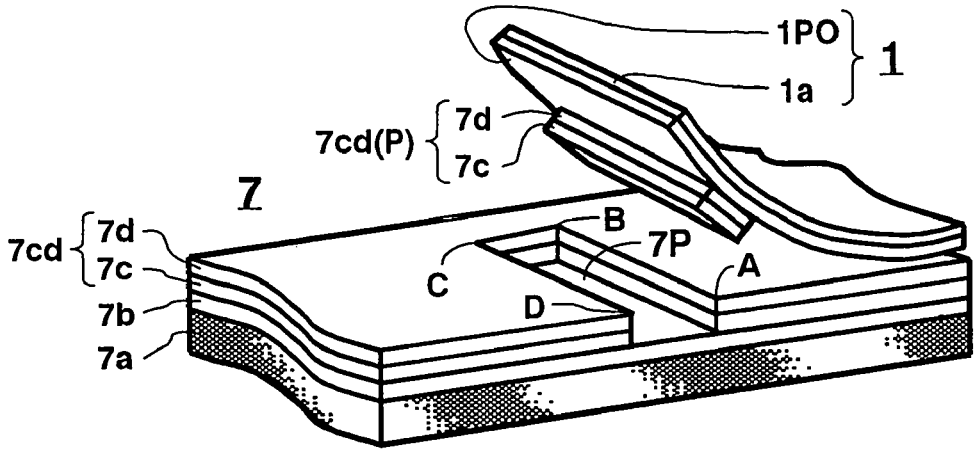
Figure 2C:
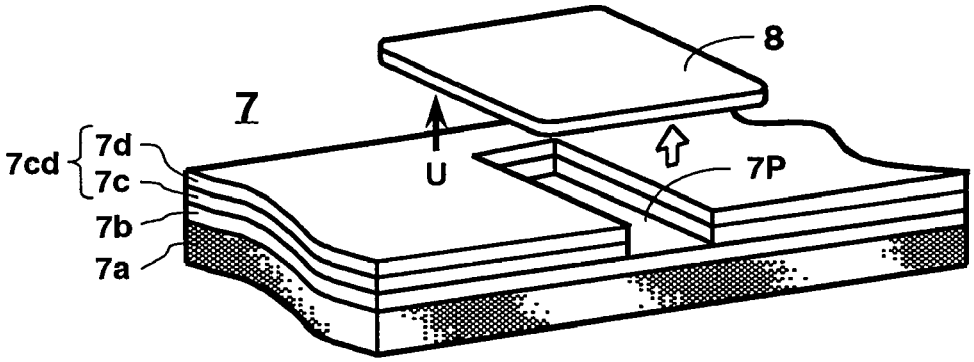
Figure 2D:
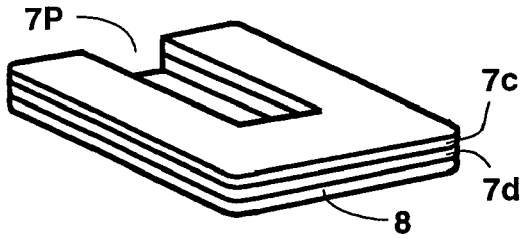

With referring to FIGS. 1–2(*d*) and 8–9(*c*), a printing apparatus of a retransfer printing method and its printing processes common to a first and second embodiments of the present invention is depicted.

FIG. 1 is a perspective view of an ink ribbon used in a printing apparatus of a retransfer printing method according to embodiments of the present invention.

FIG. 2(*a*) is a perspective view of an intermediate transfer film used in the printing apparatus of the retransfer printing method according to the embodiments of the present invention.

FIG. 2(*b*) is a perspective view of the intermediate transfer film shown in FIG. 2(*a*) exhibiting a peeling off process.

FIG. 2(*c*) is a perspective view of the intermediate transfer film shown in FIG. 2(*b*) showing a process of re-transferring a peeling area to a printing medium in a card shape.

FIG. 2(*d*) is a perspective view of the printing medium viewed from an arrow "U" direction in FIG. 2(*c*), wherein the peeling area shown in FIG. 2(*c*) is re-transferred to the printing medium.

Figure 8:
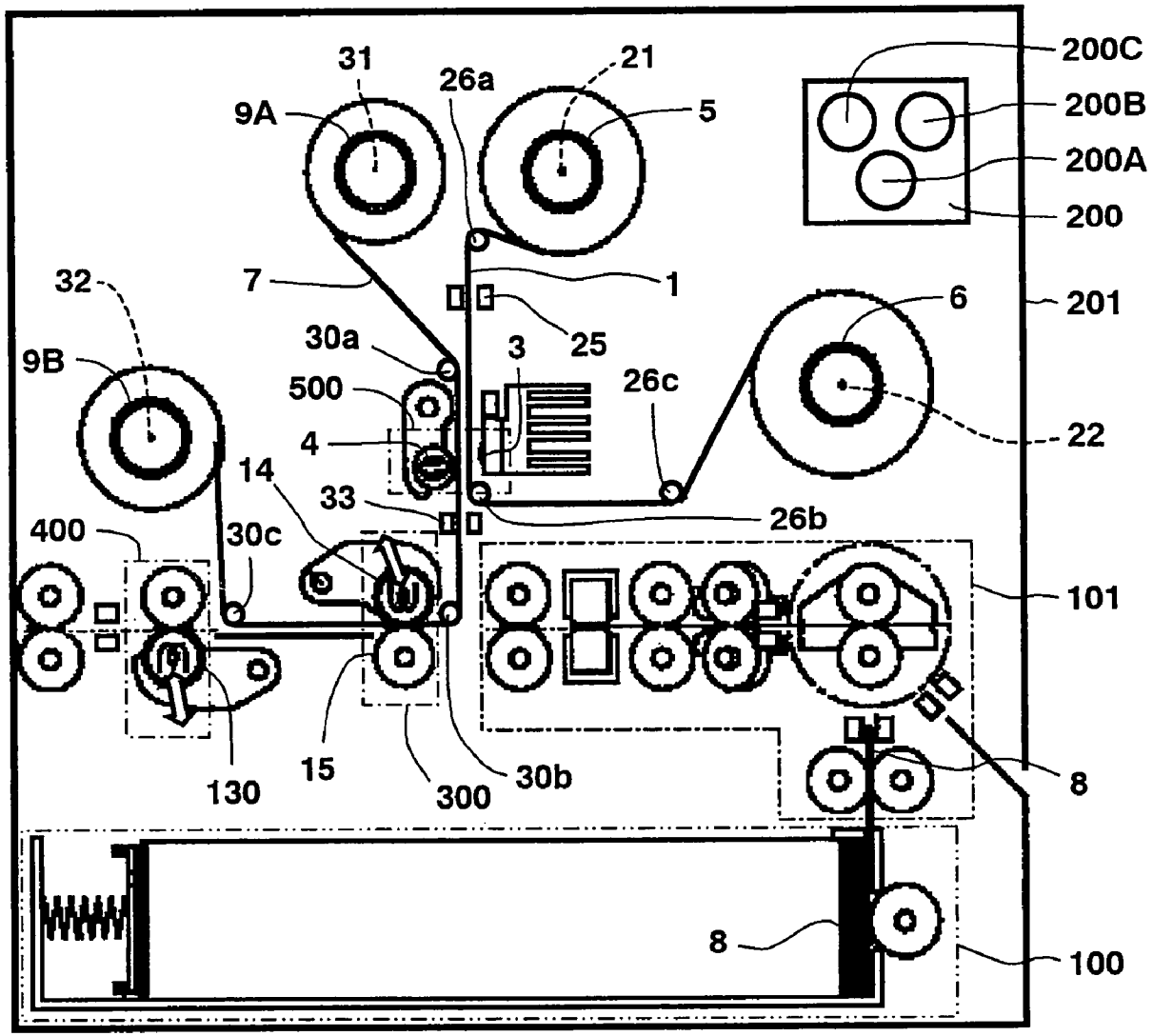
FIG. 8 is a plan view of a printing apparatus in accordance with retransfer printing methods of the first and second embodiments of the present invention.

FIG. 8 is a plan view of a printing apparatus in accordance with retransfer printing methods of the first and second embodiments of the present invention.

Figure 9A:
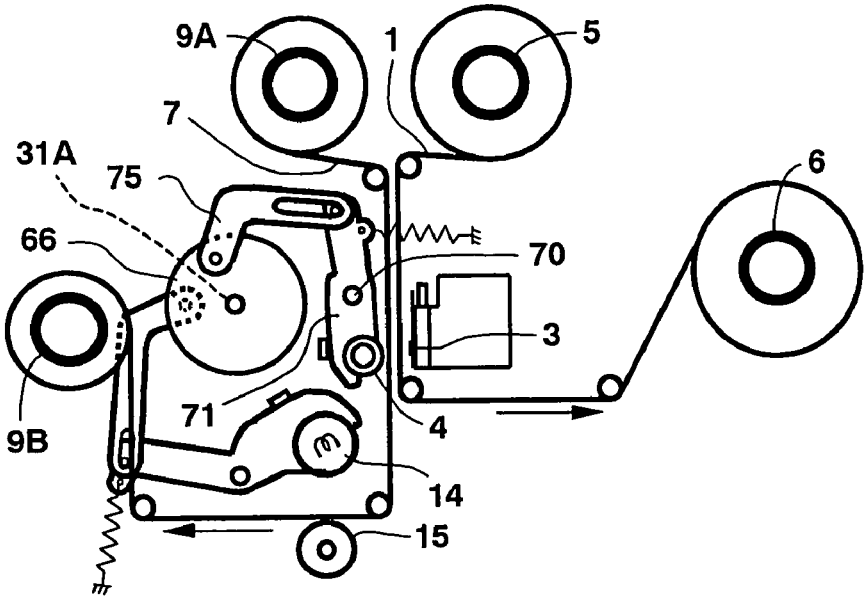
FIGS. 9(*a*) to 9(*c*) shows operations of the printing apparatus shown in FIG. 8 according to the present invention.
Figure 9B:
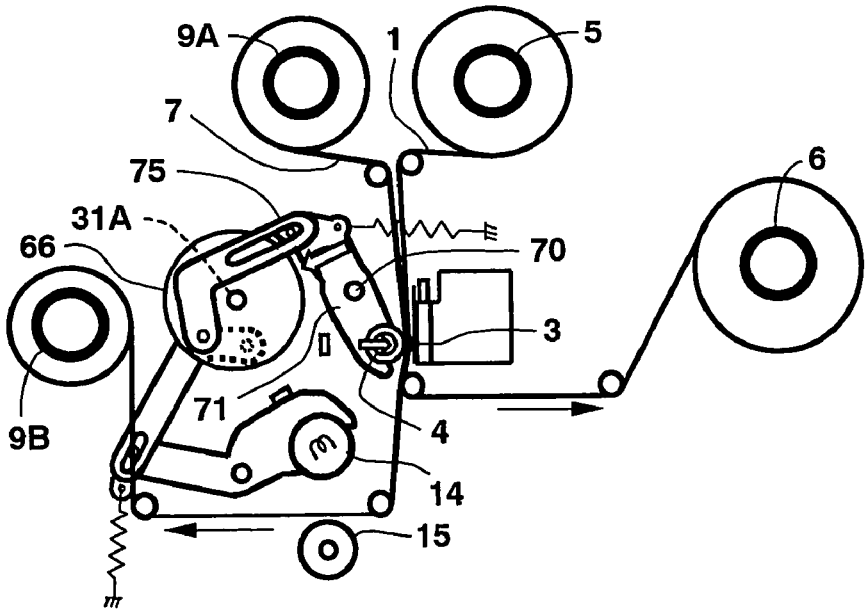
Figure 9C:
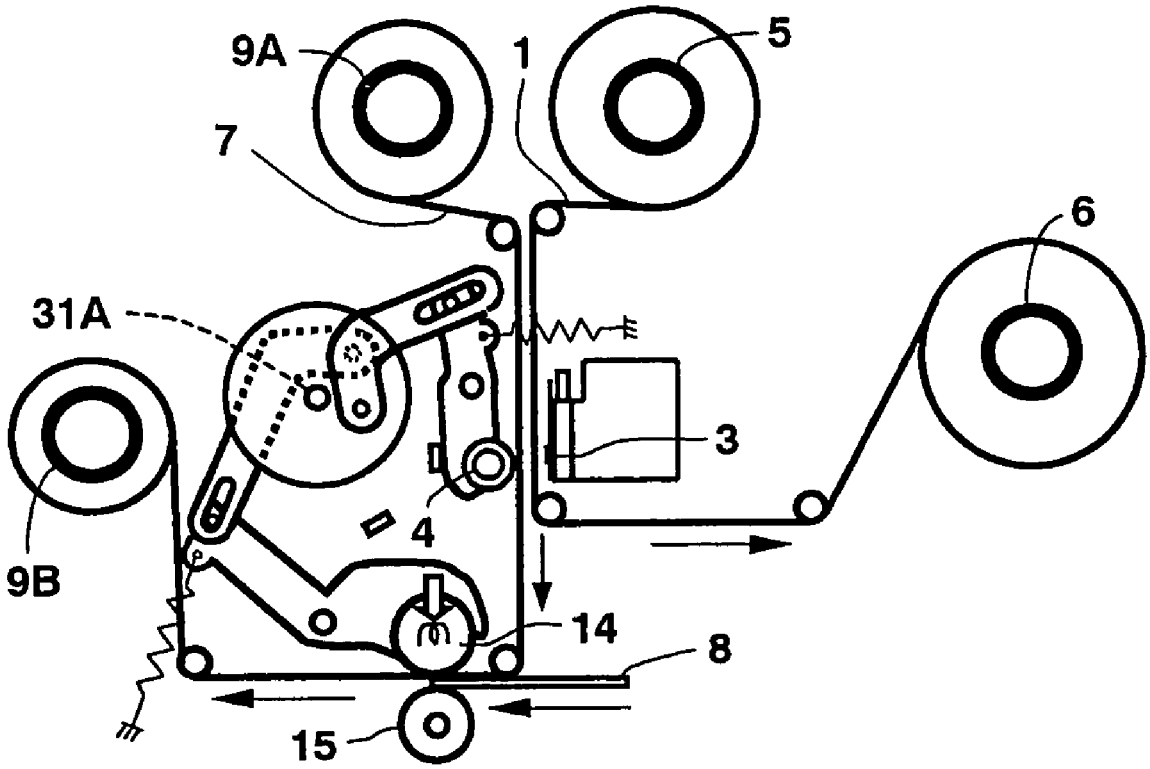

FIGS. 9(*a*) to 9(*c*) shows an operation of the printing apparatus shown in FIG. 8 according to the present invention.

In reference to FIG. 8, a total constitution of a printing apparatus of a retransfer printing method according to embodiments of the present invention is explained first.

In FIG. 8, a printing apparatus of a retransfer printing method according to the embodiments of the present invention is composed of an ink ribbon 1, a thermal head 3, a platen roller 4, a first supply reel 5, a first take-up reel 6, an intermediate transfer film 7, a card 8, a second supply reel 9A, a second take-up reel 9B, a first heat roller 14, a pressure roller 15, a first DC (direct current) motor 21 for driving the first supply reel 5, a second DC motor 22 for driving the first take-up reel 6, a first sensor 25 for indexing the ink ribbon 1, a first group of guiding members 26*a* through 26*c* for guiding the ink ribbon 1, a second group of guiding members 30*a* through 30*c* for guiding the intermediate transfer film 7, a first step motor 31 for driving the second supply reel 9A, a third DC motor 32 for driving the second take-up reel 9B, a second sensor 33 for indexing a frame of the intermediate transfer film 7, a card compartment 100 containing a plurality of cards 8, a transportation mechanism 101, a second heat roller 130, a control section 200, a chassis 201, a second heating section 300, a third heating section 400 and a first heating section 500. The control section 200 controls transfer operations and is further composed of a control pattern producing section 200A, a temperature control section 200B and a pitch control section 200C.

In the printing apparatus of the present invention, the first heating section 500 transfers ink on the ink ribbon 1 to the intermediate transfer film 7 and forms a transfer layer on the intermediate transfer film 7. The transfer layer formed on the intermediate transfer film 7 is re-transferred to the card 8 that is a printing medium in the second heating section 300. The card 8 is transported to the second heating section 300 by means of the transportation mechanism 101.

Further, in FIG. 8, the ink ribbon 1 is extended between the first supply reel 5 and the first take-up reel 6, wherein a surface of the ink ribbon 1 coated with ink faces toward the platen roller 4.

As shown in FIG. 1, the ink ribbon 1 is coated with three colors of meltable or sublimation ink composed of yellow (Y) 1Y, magenta (M) 1M, and cyan (C) 1C and a peel functional layer 1PO, wherein one set of the three color ink and the peel functional layer 1PO is cyclically coated on a base film la in a belt shape as one frame.

Furthermore, the ink ribbon 1 is not limited to be coated by three colors. It is also acceptable that coating four color ink of yellow (Y), magenta (M), cyan (C), and black (K) and a peel functional layer 1PO cyclically so as to be one frame.

The first and second DC motors 21 and 22, which are utilized for transporting the ink ribbon 1 as a power source, are connected to the first supply reel 5 and the first take-up reel 6 respectively by way of a deceleration mechanism (not shown). An encoder (not shown) is installed in the first and second DC motors 21 and 22 respectively. The encoder enables to detect a rotation angle or a number of revolutions.

The first DC motor 21 connected to the first supply reel 5 is capable of driving the first supply reel 5 to an opposite direction to a regular revolving direction of the first supply reel 5 so as to rewind the ink ribbon 1 or so as to apply an appropriate back tension to the ink ribbon 1.

Further, by changing a voltage across the first DC motor 21 in accordance with a residual amount of the ink ribbon 1 wound around the first supply reel 5, a constant back tension can always be applied to the ink ribbon 1. A residual amount of the ink ribbon 1, which corresponds to a diameter of the ink ribbon 1 wound around the first supply reel 5, can be calculated by detecting a rotation angle of the first DC motor 21 in response to one frame of the ink ribbon 1 passing through the first sensor 25 that is provided in the neighborhood of the first supply reel 5.

The second DC motor 22 connected to the first take-up reel 6 adds an optimum pulling tension to the ink ribbon 1 by applying a voltage in response to a diameter of the ink ribbon 1 wound around the first take-up reel 6 to the second DC motor 22 while printing as well as taking up the ink film 1.

Furthermore, the encoder (not shown) installed in the first or second DC motor 21 or 22 detects a transportation amount of the ink ribbon 1, and controls the transportation amount.

The thermal head $^{3}$, which is a component of the first heating section 500, is securely allocated in a place facing toward an outer surface or the base film 1*a* side (not coated with ink) of the ink ribbon 1. On the contrary, the platen roller 4, which is another component of the first heating section 500, is allocated in a place facing toward the ink coated surface of the ink ribbon 1, wherein the platen roller 4 is allocated so as to contact with or separate from the thermal head 3. The thermal head 3 hereupon is a thermal head unit that is constituted by a plurality of modular heads arranged in line, wherein each of the plurality of modular heads corresponds to each dot of an image to be printed respectively. Hereinafter the thermal head 3 denotes the thermal head unit unless otherwise specifically described.

The first sensor 25 for indexing ink is provided in a middle of a path of the ink ribbon 1 so as to index Y (yellow) color ink on the ink ribbon 1. Indexing a second or above color ink: M (magenta)), C (cyan), or K (black) color ink, and the peel functional layer 1PO is conducted by the encoder (not shown) installed in the first or second DC motor 21 or 22. With respect to the first sensor 25, there exist various detection types such as detecting a detection mark or a boundary between colors.

Further, the ink ribbon 1 is taken up by the first take-up roller 6 being guided by the first group of guiding members 26*a* through 26*c*.

As shown in FIG. 2(*a*), the intermediate transfer film 7 is composed of a substrate sheet 7*a* in a belt shape, a peeling layer 7*b*, a transparent protective layer 7*c* and an ink acceptance layer 7*d*, wherein they are sequentially laminated thereon.

Further, the ink acceptance layer 7*d*, which is the outermost layer of the intermediate transfer film 7, and the protective layer 7*c* functions as a transfer layer 7*cd*. The peeling layer 7*b* is provided for peeling off the transfer layer 7*cd* from the substrate sheet 7*a*. A detection mark (not shown) is printed on the intermediate transfer film 7 at each frame of an image to be printed. As shown in FIG. 9, the intermediate transfer film 7 is extended between the second supply reel 9A and the second take-up reel 9B, wherein the transfer layer 7*cd* of the intermediate transfer film 7 faces toward the ink ribbon 1.

A pulse motor or the step motor 31, which is utilized for transporting the intermediate transfer film 7 as a power source, is connected to the second supply reel 9A, and the third DC motor 32 is connected to the second take-up reel 9B by way of a deceleration mechanism (not shown) respectively.

Further, an encoder (not shown) is installed in the third DC motor 32. The encoder enables to detect a rotation angle or a number of revolutions of the third DC motor 32.

The intermediate transfer film 7 is led out from the second supply reel 9A and passes along the guide member 30*a*, the platen roller 4, the second sensor 33 and the guide member 30*b*, and passes through a gap between the first heat roller 14 and the pressure roller 15 constituting the second heating section 300, and passes along the guide member 30*c*, and finally taken up by the second take-up reel 9B.

Accordingly, ink on the ink ribbon 1 faces toward the transfer layer 7*cd* of the intermediate transfer film 7 in the gap between the thermal head 3 and the platen roller 4.

In addition thereto, the first heat roller 14 enables to contact with or separate from the platen roller 15.

As shown in FIG. 8, the card compartment 100, which contains a plurality of cards 8 arranged in a row, is provided in the lower part of the printing apparatus. Each of the plurality of cards 8 is sequentially taken out from the card compartment 100 and transported to the second heating section 300 through the transportation mechanism 101.

The printing apparatus of the retransfer printing method according to the present invention is equipped with the control section 200 in the chassis 201. The control section 200 is composed of the control pattern producing section 200A, which produces a control pattern for controlling the thermal head 3 in response to each color formed on the ink ribbon 1, the temperature control section 200B, which controls an amount of energy applied to the thermal head 3 that acts upon the peel functional layer 1PO during a peeling off process to be detailed later, and the pitch control section 200C, which controls a feeding pitch of the ink ribbon 1 and the intermediate transfer film 7 respectively. The control pattern producing section 200A and the pitch control section 200C will be detailed later.

Further, the printing apparatus is equipped with an information input section (not shown) for inputting external information. Image data of an image to be printed are inputted to the information input section. Inputting image data is enabled by using the commonly known methods by means of communications or mediums in disciform.

With referring to FIGS. 9(*a*) through 9(*c*) together with FIG. 8, a mode changing of the platen roller 4 and the first heat roller 14 is explained next. The first heat roller 14 is pressed against and separated from the pressure roller 15 by a rotation of a cam 66. On the contrary, the platen roller 4 is pressed against and separated from the thermal head 3 by a rotation of the cam 66.

A driving mechanism for the platen roller 4 is explained first. As shown in FIG. 9(*a*), the driving mechanism for the platen roller 4 is composed of a pivot 70, a arm 71 provided with the platen roller 4 on one end, a link 75 for transmitting torque to the arm 71 and the cam 66 that converts torque to projectile force and transmits the projectile force to the link 75. The pivot 70 is a center axis of rotation of the arm 71, so that the arm 71 swings with centering the pivot 70. The other end of the arm 71 is engaged with the link 75 by means of a link pin provided on the arm 71. The cam 66 is rotated by a second step motor 31A by way of a deceleration mechanism (not shown).

In the above-mentioned constitutions, pressing the first heat roller 14 against and separating it from the pressure roller 15 is conducted by changing a phase of the cam 66. Consequently, each phase of the cam 66 corresponds to three modes A, B and C shown in FIGS. 7(*a*) through 7(*c*) respectively.

In a case of an A-mode shown in FIG. 9(*a*), the heat roller 14 is separated from the pressure roller 15 while the platen roller 4 is separated from the thermal head 3.

Further, in a case of a B-mode shown in FIG. 9(*b*) the heat roller 14 is separated from the pressure roller 15. On the contrary, the platen roller 4 presses against the thermal head 3.

Furthermore, in a case of a C-mode shown in FIG. 9(*c*), the heat roller 14 presses against the pressure roller 15 while the platen roller 4 is separated from the thermal head 3.

With referring to the above-mentioned constitutions, operations of transferring and re-transferring are detailed.

In following operational descriptions, the ink ribbon 1 is defined to be formed with three color ink layers of Y, M and C cyclically as shown in FIG. 1. However, an ink ribbon 1 formed with four color ink layers of Y, M and C added with K (black) is the same manner as the ink ribbon 1 formed with three color ink layers.

A. Transfer Operation

A transfer operation is conducted in the above-mentioned B-mode shown in FIG. 9(*b*). Actually, in the B-mode, transferring an ink layer on the ink ribbon 1 to the intermediate transfer film 7 and peeling off the ink layer transferred to the intermediate film 7 from an area corresponding to a non-transfer area is conducted.

A control pattern produced by the control pattern producing section 200A in accordance with each color ink layer of Y, M and C on the ink ribbon 1 is transmitted to the thermal head 3, and then each color image is thermally transferred to the surface of the intermediate transfer film 7 sequentially.

Succeedingly, some of the plurality of modular heads in the thermal head 3 are heated in accordance with a non-transfer area of an image to be printed. By heating the thermal head 3, a part of the transfer layer 7*cd*, hereinafter referred to as transfer layer 7*cd*(P), on the intermediate transfer film 7 is adhered to the peel functional layer 1PO on the ink ribbon 1 while passing through the first heating section 500. As shown in FIG. 2(*b*), the transfer layer 7*cd*(P) having an area ABCD corresponding to a non-transfer area 7P is peeled off from the intermediate transfer film 7 when the ink film 1 is apart from the intermediate transfer film 7 after passing along the guide member 26*b*.

B. Retransfer Operation

A retransfer operation is conducted in the C-mode shown in FIG. 9(*c*) with respect to the card 8.

As shown in FIG. 8, one card 8 transported from the card compartment 100 is further transported to the second heating section 300 through the transportation mechanism 101. The card 8 transported to the second heating section 300 is led into a gap between the heat roller 14 and the pressure roller 15 while the surface to be printed of the card 8 faces toward the transfer layer 7*cd* on the intermediate transfer film 7 as shown in FIG. 2(*c*). By applying heat and pressure thereto, the transfer layer 7*cd* having the non-transfer area 7P formed on the intermediate transfer film 7 is transferred, that is, re-transferred to the card 8 as shown in FIG. 2(*d*).

As shown in FIGS. 2(*c*) and 2(*d*), the card 8 is formed with the non-transfer area 7P that corresponds to the non-transfer area 7*cd*(P), which is peeled off from the intermediate transfer film 7 as shown in FIG. 2(*b*) while transferring, and is not re-transferred to or not printed on the card 8. The non-transfer area 7P is capable of being designated in an arbitrary area or shape by the control pattern producing section 200A.

The thermal head 3 is constituted by components such as an exothermic resistor element, a glass substrate holding the exothermic resistor element and a ceramic base supporting the glass substrate. Supplying heating energy more is suitable for raising a temperature of the thermal head 3 rapidly during an initial period of increasing a temperature of the thermal head 3, because these constitutional components possess respective thermal capacity.

Further, in a case that the thermal head 3 overheats excessively and results in exceeding a predetermined temperature P3 (to be explained later), peeling function of the peeling layer 7*b* provided in the intermediate transfer film 7 is deteriorated and results in generating a defective portion not to be peeled off in a peeling area.

Furthermore, in order to form a predetermined peeling area accurately by forming a boundary between a peeling area and a non-peeling area clearly, it is desirable for a falling temperature of the thermal head 3 to be descended rapidly.

Accordingly, the printing apparatus according to the embodiments of the present invention is provided with the temperature control section 200B as shown in FIG. 8 so as to optimize a temperature of the thermal head 3. The temperature control section 200B controls supplying energy for heating the thermal head 3 so as to conduct a peeling off process excellently.

The supplying energy hereupon denotes electrical power amount that is supplied to the thermal head 3 per unit feeding pitch or one line of the ink ribbon 1, wherein one line is equivalent to one bit of an image to be printed. Controlling the supplying energy according to the present invention is conducted by a pulse control method, wherein electric voltage and current are kept constant. However, it should be understood that the control method is not limited to the pulse control method, but applicable to an electric current-value control method.

The control method is conducted by a preset control pattern of supplying energy that is supplied to the thermal head 3.

Further, the control pattern is set so as to have at least any one of following features (1) through (4).

(1) In a case that a relative location of the thermal head 3 moves from a non-peeling area 7NP (to be mentioned below) to a peeling area 7P, an energy amount to be supplied to an area in the neighborhood of a boundary between the non-peeling area 7NP and the peeling area 7P is made larger than an energy amount to be supplied to the other areas.

(2) The neighborhood of the boundary mentioned above is defined as a range, which contains at least 2 lines or 2 dots of the boundary area that belongs to the peeling area 7P or more. A line and a dot will be explained later.

(3) Energy in some extent that does not conduct peeling is supplied to the thermal head 3 although the thermal head 3 is allocated in the non-peeling area 7NP. This supplying energy is denominated as pre-heating.

(4) In the peeling area 7P, there exists an area, wherein supplied energy decreases along a relative moving direction Dth (to be mentioned below) of the thermal head 3.

First Embodiment

In reference to FIGS. 3(*a*) to 5(*b*), an actual energy control pattern having the above-mentioned features (1) to (3) is explained next.

Figure 3A:
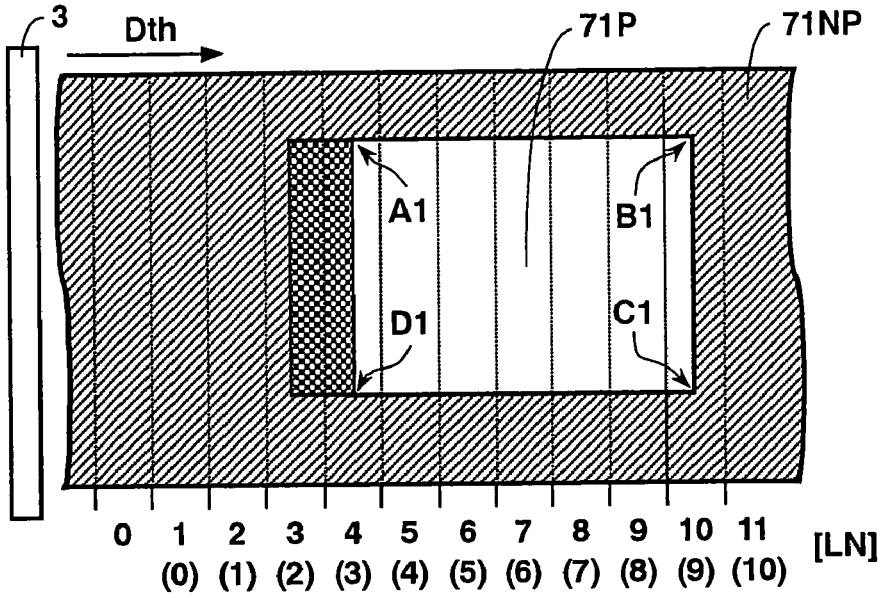
FIG. 3(*a*) shows a peeling area formed on the intermediate transfer film according to a first embodiment of the present invention.
Figure 3B:
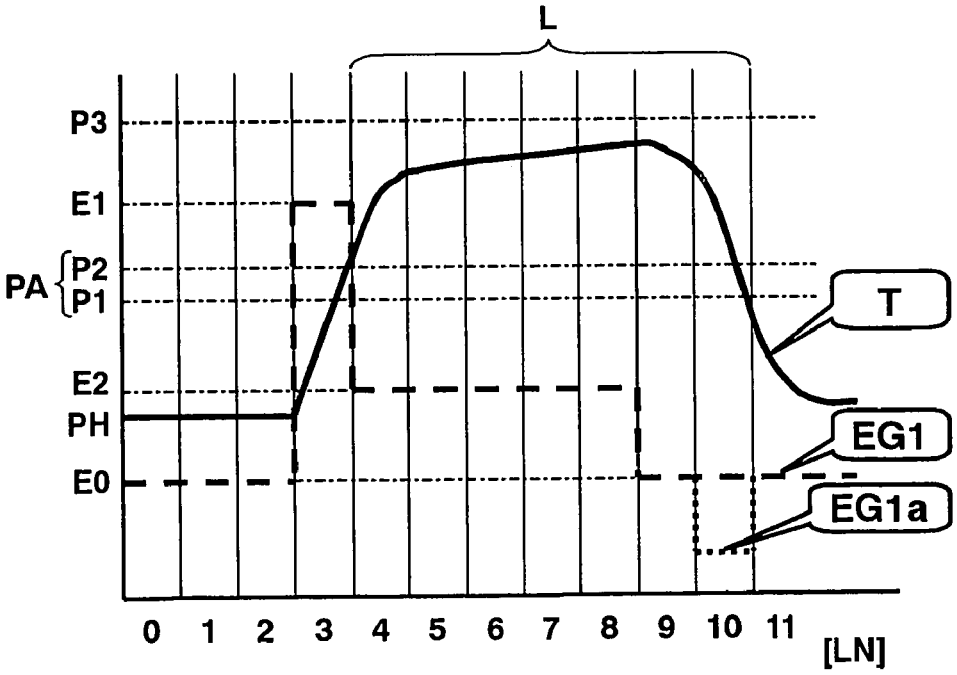

FIG. 3(*a*) shows a peeling area 71P formed on the intermediate transfer film 7 according to a first embodiment of the present invention.

FIG. 3(*b*) shows a first energy control pattern EG1 applied to a thermal head 3 of the printing apparatus so as to form the peeling area shown in FIG. 3(*a*) excellently.

Figure 4:
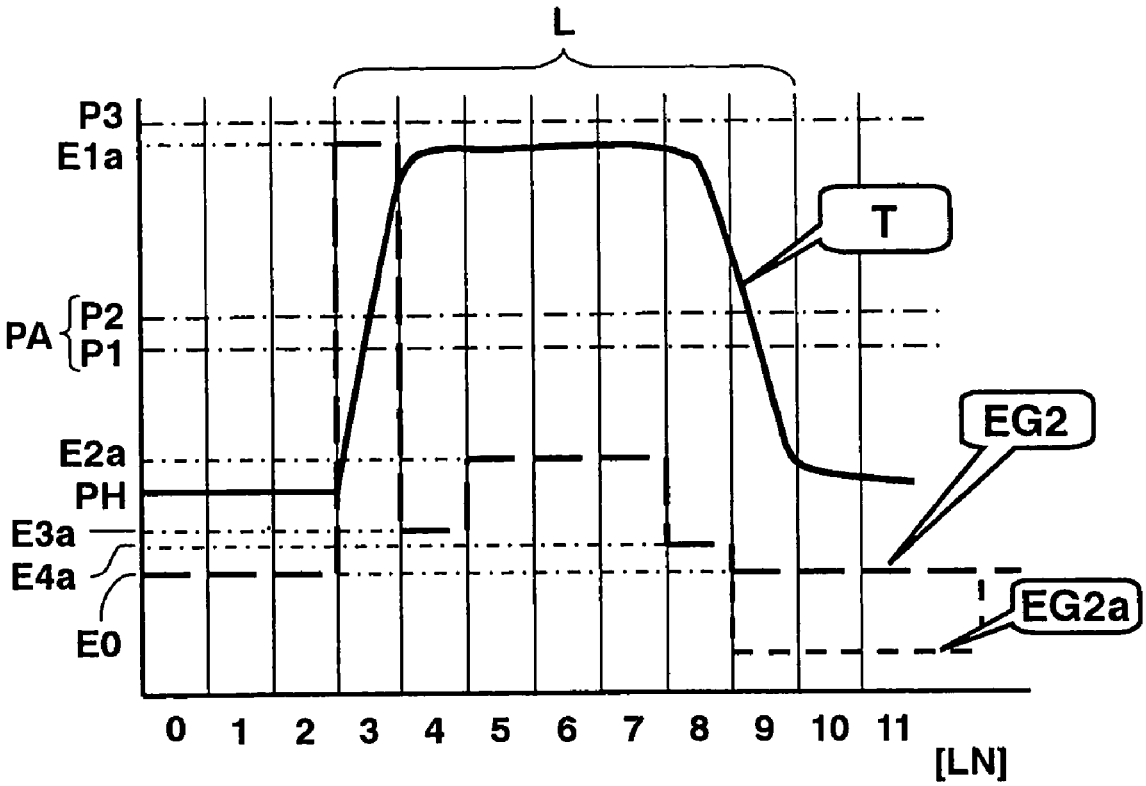
FIG. 4 shows a second energy control pattern applied to the thermal head of the printing apparatus so as to form the peeling area shown in FIG. 3(*a*) according to the first embodiment of the present invention.

FIG. 4 shows a second energy control pattern EG2 applied to the thermal head 3 of the printing apparatus so as to form the peeling area shown in FIG. 3(*a*) according to the first embodiment of the present invention.

Figure 5A:
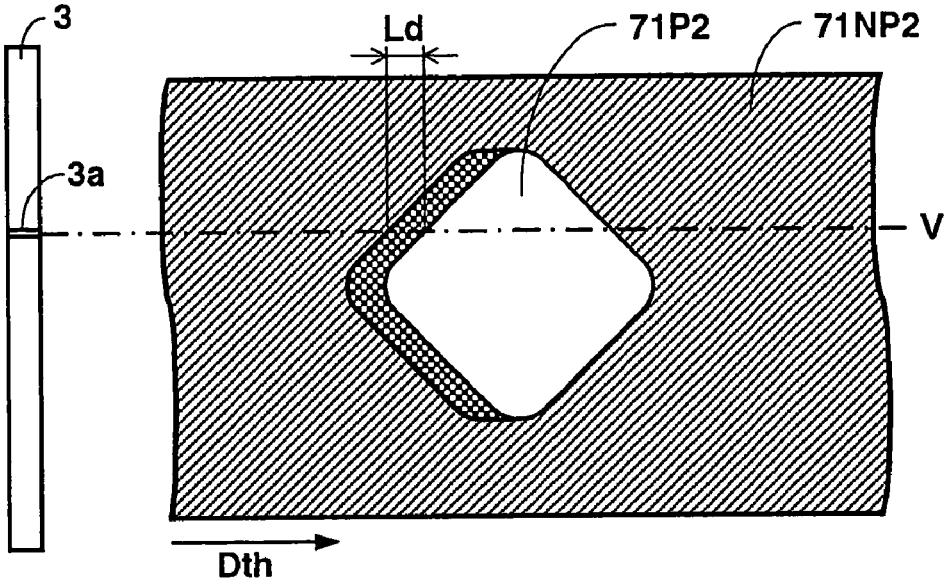
FIGS. 5(*a*) and 5(*b*) show another peeling area to be formed on the intermediate transfer film according to the first embodiment of the present invention.
Figure 5B:
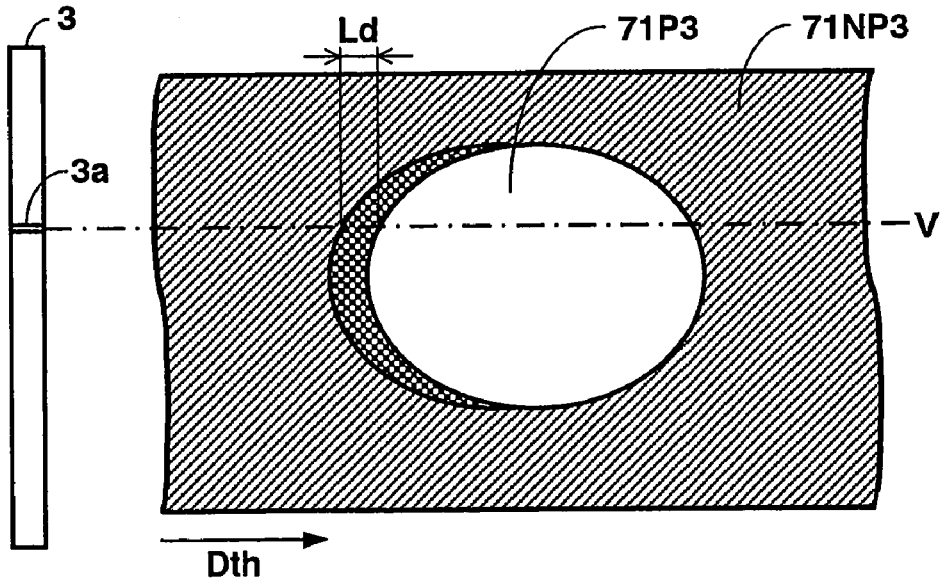

FIGS. 5(*a*) and 5(*b*) show another peeling area to be formed on the intermediate transfer film according to the first embodiment of the present invention.

In FIG. 3(*a*), the thermal head 3 and a relative moving direction Dth of the thermal head 3 is indicated on the drawing for easier understanding. The thermal head 3 is fixed securely and the ink ribbon 1 and the intermediate transfer film 7 moves along the thermal head 3 actually. However, it is described for easier understanding that the thermal head 3 moves to the relative moving direction Dth along the intermediate transfer film 7.

Numerals "0" to "11" indicated on the lower part of FIGS. 3(*a*) to 4 denote a line number (hereinafter referred to as LN) of an image to be printed along the relative moving direction Dth of the thermal head 3.

Further, in FIG. 3(A), numerals in parenthesis are LN (line numbers) corresponding to the second energy control pattern EG2 shown in FIG. 4.

These drawings are simplified and exemplarily exhibited for easier understanding. An actual LN pitch is small as fine as the order of 300 dpi (dots per inch) or 118 dots per centimeter in resolution.

The peeling area 71P in FIG. 3(*a*) is in a rectangular shape having four corners A1, B1, C1 and D1 and ranging over from LN4 to LN10. In a case of the second energy control pattern EG2, the rectangular shape ranges over from LN3 to LN9.

In FIG. 3(*b*), the X-axis denotes LN and the Y-axis denotes supplying energy (E) and a temperature (P) of the thermal head 3. A reference sign T denotes a temperature of the thermal head 3.

Further, a reference sign L denotes a predetermined range to form the peeling area 71P, wherein the predetermined range L begins with LN4.

A reference sign PA on the Y-axis denotes a minimum limit temperature, wherein the peel functional layer 1PO enables to exhibit peeling function excellently down to the minimum limit temperature PA. The minimum limit temperature PA varies by scattering of thermal capacity of materials constituting the thermal head 3. Lower and upper limits of the scattering are exhibited by temperatures P1 and P2 respectively.

More accurately, a part of the peel functional layer 1PO that is heated by the thermal head 3 begins to exhibit peeling function at the lower limit temperature P1 and whole area of the peel functional layer 1PO exhibits the peeling function totally at the upper limit temperature P2 or more.

Accordingly, the faster a temperature T of the thermal head 3 is raised up to an upper limit temperature P2 or more, the more clearly and accurately a non-peeling area 71NP and the peeling area 71P and a boundary between them enables to be formed.

Further, a peeling area formed by the second energy control pattern EG2 shown in FIG. 4 is similar to the peeling area 71P shown in FIG. 3(*a*) that is formed by the first energy control pattern EG1 shown in FIG. 3(*b*) except for LN. The first and second energy control patterns EG1 and EG2 are detailed below in accordance with the relative moving direction Dth of the thermal head 3.

A. First Energy Control Pattern EG1

(1) In a case that a location of the thermal head 3 is within a range of LN0 to LN2:

As shown in FIG. 3(*b*), energy having a value E0 is supplied to the thermal head 3 in accordance with the feature (3) mentioned above. Supplying the energy E0 is pre-heating that makes temperature difference between an initial temperature PH of the thermal head 3 and the limit temperature P1 or P2, which enables to exhibit the peeling function of the peel functional layer 1PO, smaller. Consequently, a temperature of the thermal head 3 maintains the initial temperature PH.

(2) In a case that a location of the thermal head 3 is within a range of LN3:

Supplying energy is raised up to E1 within the range of LN3 in accordance with the features (1) and (2) mentioned above. The energy value E1 is the maximum energy value in the first energy control pattern EG1. As mentioned above, a predetermined peeling area 71P to be formed begins with LN4. Therefore, the supplying energy is increased up to the maximum energy E1 at LN3 prior to LN 4 by one line in consideration of the thermal capacity of the thermal head 3. Supplying the maximum energy E1 raises the temperature T of the thermal head 3 from the initial temperature PH rapidly, and resulting in exceeding the upper limit temperature P2 at LN4 although the temperature T is less than the lower limit temperature P1 in the range of LN3.

In addition thereto, a crosshatched area in FIG. 3(*a*) is a part of the non-peeling area 71NP, wherein the peel functional layer 1PO does not exhibit peeling function but the crosshatched area is affected by a rising temperature of the thermal head 3 until the temperature T exceeds the upper limit temperature P2.

Consequently, the intermediate transfer film 7 is not peeled off at LN3 in the all area of the peel functional layer 1PO heated by the thermal head 3 and is peeled off at LN4 or up, so that a boundary between the non-peeling area 71NP and the peeling area 71P is formed clearly and excellent in parting.

(3) In a case that a location of the thermal head 3 is within a range of LN4 to LN8:

Supplying energy is reduced to an energy value E2, which satisfies a relation of E0<E2<E1, in accordance with the feature (1) mentioned above. Setting the supply energy down to the energy value E2 enables to prevent a temperature caused by heat accumulating of the thermal head 3 from reaching to a maximum temperature P3, which impairs peeling function of the peeling layer 71P.

It is desirable for the energy value E2 to be set to a specific value, which balances inputting heat to and outputting heat from the thermal head 3, in view of thermal capacity of and radiating heat from the thermal head 3. Consequently, a temperature of the thermal head 3 is maintained between the upper limit temperature P2 and the maximum temperature P3.

(4) In a case that a location of the thermal head 3 is within a range of LN9 or more:

Supplying energy is reduced from E2 to the initial energy value E0. In this connection, the temperature T of the thermal head 3 decreases gradually and falls below the lower limit temperature P1 in the range of LN10 and up.

Further, in a case of cooling down the thermal head 3 rapidly, it should be considered that supplying energy is reduced to below E0 once, and then raised up to E0 as shown by a doted line EG1a in FIG. 3(*b*).

As mentioned above, according to the first energy control pattern EG1, a boundary between a non-peeling area and a peeling area is clearly formed without producing a not peeled off part in the peeling area.

Further, a predetermined peeling area enables to be formed accurately.

B. Second Energy Control Pattern EG2

Thermal effects and functions of the thermal head 3 caused by the second energy control pattern EG2 are similar to those of the first energy control pattern EG1, so that detailed explanations of the same effects and functions are omitted.

(1) In a case that a location of the thermal head 3 is within a range of LN0 to LN2.

As shown in FIG. 4, supplying energy is set to the initial energy value E0 as the same manner as that of the above-mentioned first energy control pattern EG1.

(2) In a case that a location of the thermal head 3 is within a range of LN3:

Supplying energy is set to a maximum energy value E1*a* as the same manner as that of the above-mentioned first pattern EG1.

(3) In a case that a location of the thermal head 3 is within a range of LN4:

Supplying energy is reduced to an energy value E3*a*, which satisfies a relation of E0<E3*a*<E1*a*.

(4) In a case that a location of the thermal head 3 within a range of LN5 to LN7:

Supplying energy is increased up to an energy value E2*a*, which satisfies a relation of E3*a*<E2*a*<E1*a*.

In the case of the second energy control pattern EG2, it is characterized in that a specific line number LN4 in which the supplying energy is set to E3*a* being lower than E2*a* is provided prior to the range of LN5 to LN8 in which the supplying energy is kept at E2*a* as compared with the first energy control pattern EG1.

By providing the specific line number LN4, affection caused by heat accumulating of the thermal head 3 is suppressed, so that a temperature T of the thermal head 3 hardly reaches to a maximum temperature P3, which impairs peeling function of the peeling layer 71P. Therefore, a temperature T of the thermal head 3 enables to be rapidly raised by setting the larger energy value E1*a* than the energy value E1 of the first energy control pattern EG1. Consequently, The second energy control pattern EG2 is preferable energy control pattern.

(5) In a case that a location of the thermal head 3 exceeds LN8:

In the range of LN8, supplying energy is reduced to an energy value E4*a*, which satisfies a relation of E0<E4*a*<E2*a*, and then the supplying energy is further reduced to the initial energy value E0 at LN9 and up as the same manner as the first pattern EG1. This setting is a preferable energy control pattern that enables to decrease a temperature T of the thermal head 3 faster.

Further, it is also acceptable that supplying energy is reduced to below E0 once, and then raised up to E0 as shown by a doted line EG2*a* in FIG. 4.

As mentioned above, according to the second energy control pattern EG2, a boundary between a non-peeling area and a peeling area is clearly formed without producing a not peeled off part in the peeling area.

Further, a predetermined peeling area enables to be formed accurately.

According to the above-mentioned first embodiment, a peeling area is in a rectangular shape having a side extending along the relative moving direction Dth of the thermal head 3. In reference to FIGS. 5(*a*) and 5(*b*), a peeling area of which side or a shape does not extend along the relative moving direction Dth of the thermal head 3 is explained next.

FIG. 5(*a*) is a plan view of a peeling area 71P2 in a lozenge shape of which any side is not parallel to the relative moving direction Dth of the thermal head 3.

FIG. 5(*b*) is a plan view of a peeling area 71P3 in an oval shape.

In FIGS. 5(*a*) and 5(*b*), the thermal head 3 is illustrated in the drawings for easier understanding, and a reference sign 3*a* denotes one of the plurality of modular heads that constitutes the thermal head 3.

In these peeling areas shown in FIGS. 5(*a*) and 5(*b*), the first and second energy control patterns EG1 and EG2 enable to be applied to the thermal head 3 as an energy control pattern that controls the modular head 3*a* of the thermal head 3, wherein the modular head 3*a* corresponds to a line "V" extending along the relative moving direction Dth of the thermal head 3.

Further, it is understood that a line number (LN) shown in FIGS. 3(*b*) and 4 enables to be applied to FIGS. 5(*a*) and 5(*b*) as a dot number. In other words, a range Ld in which maximum energy is supplied to the modular head 3*a* is designated to be a range containing 2 dot or more of a boundary area that proceeds into the peeling area 71P2 or 71P3, in the neighborhood of a boundary between the non-peeling area 71NP2 or 71NP3 and the peeling area 71P2 or 71P3.

Comparative Example

In this comparative example, it is defined that energy supplied to the thermal head 3 is maintained in a constant value without controlling the energy value.

Figure 6A:
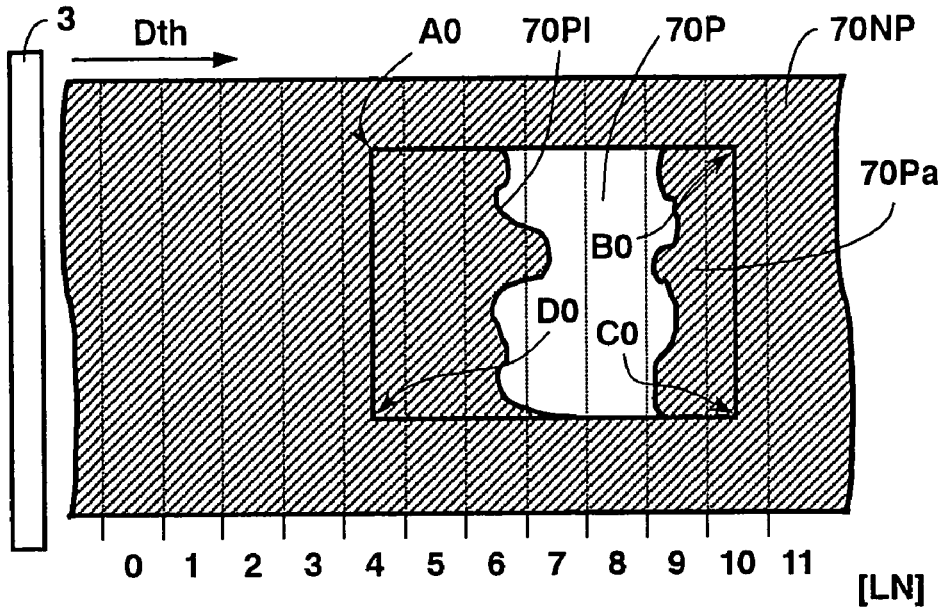
FIG. 6(*a*) shows a peeling area formed on an intermediate transfer film according to a comparative example.
Figure 6B:
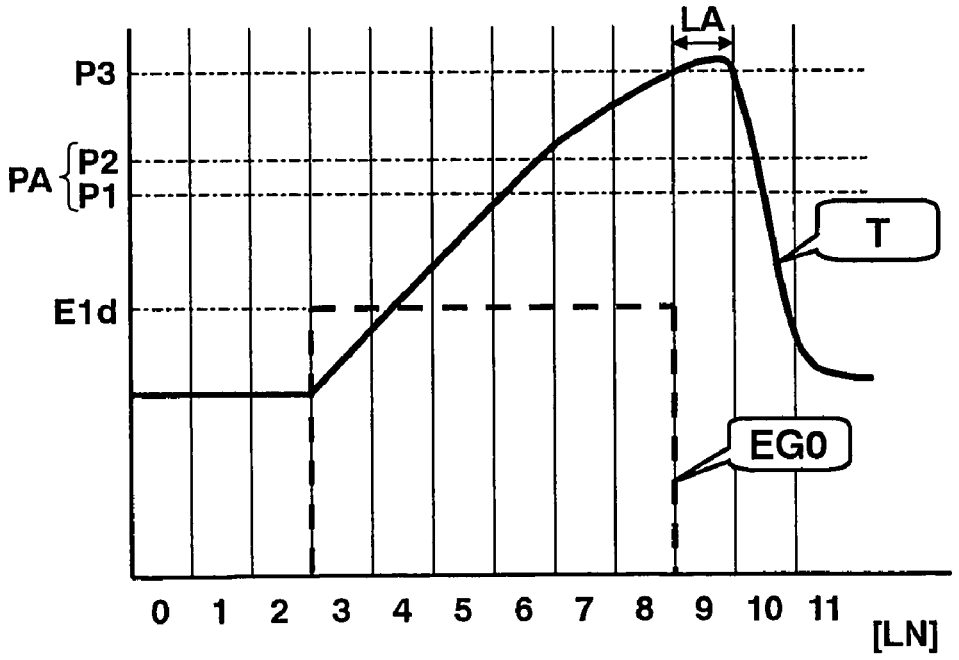

FIG. 6(*a*) is a plan view of a peeling area 70P to be peeled off and a non-peeling area 70NP on an intermediate transfer film 7 according to the comparative example. In FIG. 6(*a*), the thermal head 3 and a relative moving direction Dth of the thermal head 3 is indicated on the drawing for easier understanding.

FIG. 6(*b*) shows a conventional energy control pattern EG0 supplied to the thermal head 3 according to the comparative example. In FIG. 6(*b*), the X-axis denotes a line number LN and the Y-axis denotes supplying energy (E) and a temperature (P) of the thermal head 3.

Numerals "0" to "11" indicated on the lower part of FIGS. 6(*a*) and 6(*b*) denote a line number (LN) of an image to be printed along the relative moving direction Dth of the thermal head 3.

The peeling area 70P to be peeled off in FIG. 6(*a*) is in a rectangular shape having four corners A0, B0, C0 and D0 and ranging over from LN4 to LN10.

As mentioned in the first embodiment, the temperature PA is the minimum limit temperature for the peel functional layer 1PO to exhibit peeling function, wherein P1 and P2 denote respectively a lower limit temperature and an upper limit temperature in accordance with scattering of thermal capacity of materials constituting the thermal head 3.

In this connection, a part of the peel functional layer 1PO that is heated by the thermal head 3 begins to exhibit peeling function at a lower limit temperature P1 and whole area of the peel functional layer 1PO exhibits the peeling function totally at an upper limit temperature P2 or more.

Further, in a range where a temperature exceeds a maximum temperature P3, peeling function of the peel functional layer 1PO is deteriorated, and resulting in defective peeling function.

In a case of the conventional energy control pattern EG0 shown in FIG. 6(*b*) according to the comparative example, no energy is supplied to the thermal head 3 until LN2. However, a constant energy E1*d* is supplied to the thermal head 3 during a range of LN3 to LN 8, so that a temperature T of the thermal head 3 rises gradually. In this connection, the temperature T exceeds the upper limit temperature P2 at LN7 while the temperature T is below the upper limit temperature P2 in the range of LN6.

Consequently, as shown in FIG. 6(*a*), a borderline 70PI between the non-peeling area 70NP and the peeling area 70P is formed over two lines of LN6 and LN7. The borderline 70PI is extremely indistinct and defective in parting.

Further, a part that is not peeled off is apt to be generated in the peeling area 70P.

Furthermore, supplying constant energy to the thermal head 3 makes heat accumulating effect of the thermal head 3 remarkable, so that a temperature T of the thermal head 3 easily exceeds the maximum temperature P3, wherein a range exceeding the maximum temperature P3 is shown by a reference sign "LA" in FIG. 6(*b*). During the range of LA, a defective peeling area 70Pa, which is impossible to be peeled off, is generated regardless of inside the peeling area 70P.

As mentioned above, according to the comparative example, the defective peeling area 70Pa is generated even in the peeling area 70P. On the contrary, according to the first embodiment of the present invention, it is understood that a boundary between a non-peeling area and a peeling area is clearly formed without generating a not peeled off part in the peeling area and a predetermined peeling area enables to be formed accurately.

Second Embodiment

In order to make a boundary between the non-peeling area 7NP and the peeling area 7P clear and excellent in parting, it is understood that a temperature of the thermal head 3 shall be raised rapidly up to a limit temperature range in which the peel functional layer 1PO exhibits peeling function excellently.

In this connection, by lowering a relative moving velocity of the thermal head 3 when a location of the thermal head 3 is in the neighborhood of a boundary area when approaching from the non-peeling area 7NP to the peeling area 7P, a rising temperature of the thermal head 3 enables to be expedited substantially.

More accurately, controlling the first step motor 31 that is a power source for transporting the intermediate transfer film 7 by the pitch control section 200C makes a feeding pitch of the intermediate transfer film 7 longer at the neighborhood of an area approaching to the peeling area 7P. In reference to FIGS. 7(*a*) and 7(*b*), further details are explained next.

Figure 7A:
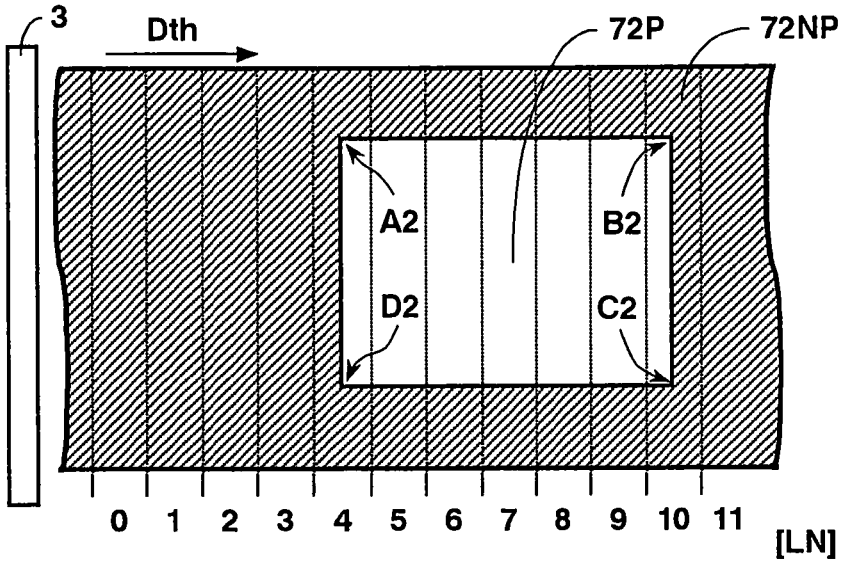
FIG. 7(*a*) shows a peeling area formed on the intermediate transfer film according to a second embodiment of the present invention.
Figure 7B:
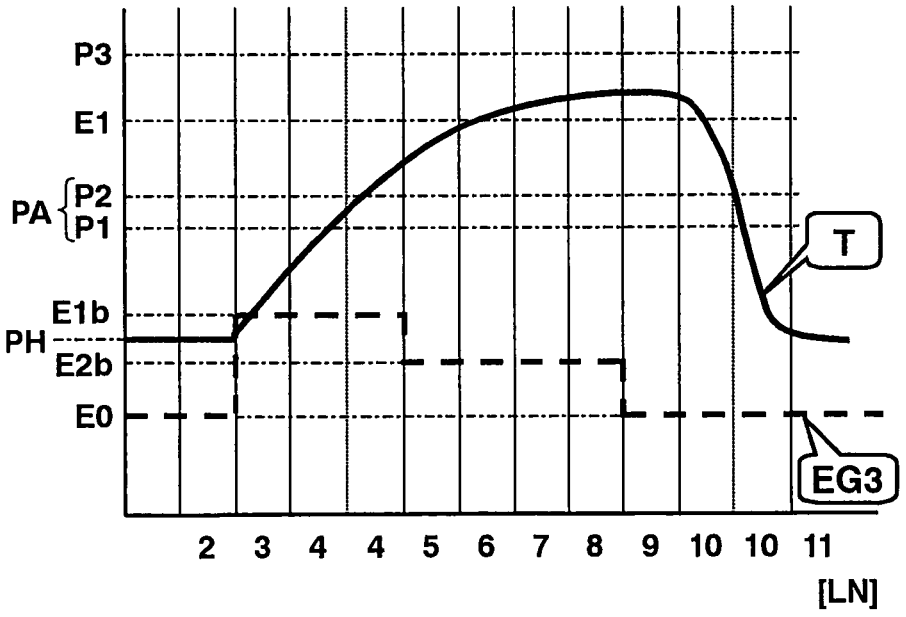

FIG. 7(*a*) shows a peeling area 72P and a non-peeling area 72NP formed on the intermediate transfer film 7 according to a second embodiment of the present invention.

FIG. 7(*b*) shows a third energy control pattern EG3 supplied to the thermal head 3 of the printing apparatus so as to form the peeling area 72P shown in FIG. 7(*a*) according to the second embodiment of the present invention.

In FIG. 7(*a*), the thermal head 3 and a relative moving direction Dth of the thermal head 3 is indicated on the drawing for easier understanding.

Further, numerals "0" to "11" indicated on the lower part of FIGS. 7(*a*) and 7(*b*) denote a line number (LN) of an image to be printed along the relative moving direction Dth of the thermal head 3.

Furthermore, the peeling area 72P in FIG. 7(*a*) is in a rectangular shape having four corners A2, B2, C2 and D2 and ranging over from LN4 to LN10.

In FIG. 7(*b*), the X-axis denotes LN (line number) and the Y-axis denotes supplying energy (E) and a temperature (P) of the thermal head 3.

Further, the X-axis is also a time base. In this second embodiment, a feeding pitch from LN4 to LN5 and from LN10 to LN11 is extended almost twice the feeding pitch in ranges other than LN4 to LN5 and LN10 to LN11. A degree of extending the feeding pitch is arbitrary determined.

As mentioned above, the temperature PA is the minimum limit temperature for the peel functional layer 1PO to exhibit peeling function excellently, wherein P1 and P2 denote respectively a lower limit temperature and an upper limit temperature in accordance with scattering of thermal capacity of materials constituting the thermal head 3.

In other words, a part of the peel functional layer 1PO that is heated by the thermal head 3 begins to exhibit peeling function at the lower limit temperature P1 and whole area of the peel functional layer 1PO exhibits the peeling function totally at the upper limit temperature P2 or more.

The third energy control pattern EG3 is similar to the above-mentioned first energy control pattern EG1. However, an amount of energy to be supplied to the thermal head 3 according to the third energy control pattern EG3 enables to be smaller than that of the first energy control pattern EG1. The second embodiment is detailed next, wherein explanations of the same thermal effects and functions as those of the first energy control pattern EG1 are omitted.

(1) In a case that a location of the thermal head 3 is within a range up to LN2:

As shown in FIG. 7(*b*), initial energy having a value E0 is supplied to the thermal head 3. Supplying the initial energy E0 is pre-heating that makes temperature difference between an initial temperature PH of the thermal head 3 and the limit temperature P1 or P2, which exhibits the peeling function of the peel functional layer 1PO, smaller. Consequently, a temperature T of the thermal head 3 maintains the initial temperature PH.

(2) In a case that a location of the thermal head 3 is within a range of LN3 to LN4:

A value of supplying energy is raised up to E1*b*. The energy value E1*b* is the maximum energy value in the third pattern EG3. However, the energy E1*b* of the third energy control pattern EG3 is smaller than the maximum energy E1 of the first energy control pattern EG1.

Further, the energy E1*b* is supplied to the thermal head 3 at the line number LN3 prior to LN4 by one line, wherein a predetermined peeling area 72P to be formed is extended over from LN4 to LN10.

A feeding pitch within the range of LN4 is extended hereupon. In this second embodiment, the extended feeding pitch is almost twice the regular feeding pitch. Consequently, a rising temperature of the thermal head 3 is advanced even by the smaller energy E1*b* than the energy E1. A temperature T of the thermal head 3 exceeds the upper limit temperature P2 in the range of LN4 although the temperature T is below the lower limit temperature P1 in the range of LN3.

As mentioned above, whole area of the peel functional layer 1PO that is heated even by the smaller energy supplied to the thermal head 3 is peeled off at LN5 and up, and resulting in obtaining a peeling boundary that is clear and excellent in accuracy.

A feeding pitch within a range of LN10 is also extended. In this second embodiment, the extended feeding pitch is almost twice the regular feeding pitch. Consequently, a falling temperature of the thermal head 3 is more advanced during this period, so that the temperature T of the thermal head 3 is surely reduced to the lower limit temperature P1 or less at LN11: nevertheless, the temperature T exceeds the upper limit temperature P2 at LN10.

Accordingly, a boundary at where its area is shifted from the peeling-area 72P,to the non-peeling area 72NP is formed stably, clearly and accurately.

Further, a not peeled off part is never produced in the peeling area 72P.

As mentioned above, the second embodiment controls a feeding pitch by means of the predetermined pitch control pattern, so that the same effect as the first embodiment enables to be obtained by the smaller supplying energy than that of the first embodiment although a printing time is increased by extending a feeding pitch. Consequently, the second embodiment is particularly suitable for a printing apparatus that is demanded for electric power saving.

Further, it is also acceptable for the second embodiment that supplying energy to be applied for the second energy control pattern EG3 is in a constant value.

Furthermore, it is understood that a pitch length and a line number (LN) for extending a feeding pitch in a pitch control pattern enables to be designated arbitrary. It is also understood that the pitch control pattern enables to be designated in combination with an energy control pattern, which enables to conduct excellent peeling in accordance with a shape of a peeling area.

A control pattern for supplying energy and a pitch control pattern is produced by the control pattern producing section 200A in accordance with a non-transfer area contained in printing image data that are inputted from an information input device. However, a producing method of a control patter is not limited to the above-mentioned method. It is also acceptable, for example, that a control pattern is previously produced and stored in an external host computer, and then the control pattern is supplied to the control pattern producing section 200A together with image data externally.

As mentioned above, according to the present invention, a boundary between the non-peeling area 7NP (71NP, 72NP) and the peeling area 7P (71P, 72P) on the intermediate transfer film 7 enables to be formed clearly.

Further, a predetermined peeling area enables to be formed accurately. Consequently, a non-retransfer area enables to be formed on a printing medium, that is, a card 8 accurately as well as forming a boundary of the non-retransfer area clearly on the surface of the card 8, wherein the non-retransfer area is a non-printed area and corresponds to a peeling area 7P.

Further, according to the printing apparatus of the present invention, nothing is transferred to a non-retransfer area on a printing medium. In a case that the printing medium is a card having a non-retransfer area, for example, terminals for external connection of an IC chip are never resulted in defective connection as far as the non-retransfer area is an area for the IC chip.

Further, in a case that the non-retransfer area is a magnetic stripe area, defective contact with a magnetic head never occurs.

Furthermore, in a case that the non-retransfer area is an area for writing a signature, ink of writing implements such as a boll point pen stays thereon securely.

While the invention has been described above with reference to specific embodiments thereof, it is apparent that many changes, modifications and variations in the arrangement of equipment and devices can be made without departing from the invention concept disclosed herein. For example, in a case that a location of the thermal head 3 is outside a peeling area, an energy control pattern for preheating is not necessary to supply a constant amount of energy. It is acceptable for an energy control pattern that energy is intermittently supplied.

Further, any energy control pattern is acceptable as far as the thermal head 3 is controlled to maintain a higher temperature as high as a temperature of the thermal head 3 never exceeds the maximum temperature P3.

Furthermore, two lines at a boundary section in which supplying energy is designated to be higher than the other areas is either the two lines prior to the boundary section as mentioned in the embodiments or two lines extended over the boundary section. Deciding either one depends upon the value E1 (E1*a*, E1*b*) of the supplying energy.

As detailed above, according to the present invention, a boundary between a peeling area and a no-peeling area on an intermediate transfer film is formed clearly and a predetermined peeling area is formed accurately without producing a not peeled off part in the peeling area.

Further, a boundary between a retransfer area and a non-retransfer area on a printing medium is formed clearly and a predetermined non-retransfer area on the printing medium is formed accurately. Consequently, a printed matter in which nothing is re-transferred to the non-retransfer area is assuredly realized.

It will be apparent to those skilled in the art that various modification and variations could be made in the present invention without departing from the scope or spirit of the invention.

What is claimed is:

1. A retransfer printing method comprising steps of:

overlapping an ink ribbon in a belt shape having both layers of a transfer ink layer containing transfer-ink and a peel functional layer thereon, on an intermediate transfer film in a belt shape having a transfer layer thereon so as to face the transfer ink layer toward the transfer layer;

moving the ink ribbon and the intermediate transfer film together to a longitudinal direction while pressing a thermal head against the back side of the ink ribbon overlapped on the intermediate transfer film;

transferring the transfer-ink to the transfer layer by heating the thermal head corresponding to an image to be printed so as to form the image composed of the transfer-ink on the transfer layer;

adhering a part of the transfer layer corresponding to a peeling area previously designated within an area of the image to the peel functional layer by heating the thermal head corresponding to the peeling area over a predetermined temperature;

peeling off the part of the transfer layer adhered to the peel functional layer from the intermediate transfer film; and re-transferring the transfer layer to the printing medium by the thermal transfer method, and resulting in printing the image on the printing medium, the retransfer printing method is further characterized in that an amount of energy, which is supplied to the thermal head so as to heat the thermal head, is changed in accordance with a location of the thermal head in the peeling area and its neighboring area during the step of peeling.

2. The retransfer printing method in accordance with claim 1, wherein the amount of energy is maximized when the thermal head is positioned in the neighborhood of a boundary area of the peeling area while the thermal head relatively moves from outside the peeling area to inside the peeling area.

3. The retransfer printing method in accordance with claim 1, wherein the amount of energy is supplied to the thermal head so as to heat the thermal head and so as to maintain a temperature of the thermal head to be less than the predetermined temperature when the thermal head is positioned outside the peeling area.

4. A printing apparatus of a retransfer printing method comprising steps of:

overlapping an ink ribbon in a belt shape having both layers of a transfer ink layer containing transfer-ink and a peel functional layer thereon, on an intermediate transfer film in a belt shape having a transfer layer thereon so as to face the transfer ink layer toward the transfer layer;

moving the ink ribbon and the intermediate transfer film together to a longitudinal direction while pressing a thermal head against the back side of the ink ribbon overlapped on the intermediate transfer film;

transferring the transfer-ink to the transfer layer by heating the thermal head corresponding to an image to be printed so as to form the image composed of the transfer-ink on the transfer layer;

adhering a part of the transfer layer corresponding to a peeling area previously designated within an area of the image to the peel functional layer by heating the thermal head corresponding to the peeling area over a predetermined temperature;

peeling off the part of the transfer layer adhered to the peel functional layer from the intermediate transfer film; and re-transferring the transfer layer to the printing medium by the thermal transfer method, and resulting in printing the image on the printing medium, wherein an amount of energy, which is supplied to the thermal head so as to heat the thermal head, is changed in accordance with a location of the thermal head in the peeling area and its neighboring area during the step of peeling, the printing apparatus comprising a control section for controlling the amount of energy supplied to the thermal head by a predetermined control pattern during the step of peeling.

5. The printing apparatus in accordance with claim 4, the printing apparatus further comprising a control pattern producing section, which produces the predetermined control pattern in accordance with a shape of a non-transfer area to be formed on the printing medium.

6. A retransfer printing method comprising the steps of:

overlapping an ink ribbon in a belt shape having both layers of a transfer ink layer containing transfer-ink and a peel functional layer thereon, on an intermediate transfer film in a belt shape having a transfer layer thereon so as to face the transfer ink layer toward the transfer layer;

moving the ink ribbon and the intermediate transfer film together to a longitudinal direction while pressing a thermal head against the back side of the ink ribbon overlapped on the intermediate transfer film;

transferring the transfer-ink to the transfer layer by heating the thermal head corresponding to an image to be printed so as to form the image composed of the transfer-ink on the transfer layer;

peeling off a part of the transfer layer adhered to the peel functional layer from the intermediate transfer film by way of adhering the part of the transfer layer corresponding to a peeling area previously designated within an area of the image to the peel functional layer by heating the thermal head corresponding to the peeling area over a predetermined temperature; and re-transferring the transfer layer to the printing medium by the thermal transfer method, and resulting in printing the image on the printing medium, wherein an amount of energy, which is supplied to the thermal head so as to heat the thermal head, is controlled in accordance with a location of the thermal head in the peeling area and its neighboring area during the step of peeling, and wherein controlling an amount of energy is such that energy having a first value is supplied to the thermal head when the thermal head relatively moves from outside the peeling area to inside the peeling area in order to conduct a temperature of the thermal head to reach to a lower limit temperature at which the peel functional layer enables to exhibit peeling function before the thermal head relatively moves from outside the peeling area to inside the peeling area, and wherein energy having a second value is supplied to the thermal head when the thermal head is in the peeling area in order to control a temperature of the thermal head not to exceed a temperature at which the peel functional layer fails to exhibit peeling function and not to fall below the lower limit temperature, and wherein the first value is larger than the second value, and wherein the second value is larger than an energy value that is supplied to the thermal head prior to supplying the energy having the first value.

7. The retransfer printing method in accordance with claim 6, wherein the location of the thermal head when the energy having the first value is supplied to the thermal head while the thermal head relatively moves from outside the peeling area to inside the peeling area is only outside the peeling area excluding inside the peeling area.

8. The retransfer printing method in accordance with claim 6, wherein the location of the thermal head when the energy having the first value is supplied to the thermal head while the thermal head relatively moves from outside the peeling area to inside the peeling area is whole area from outside the peeling area to inside the peeling area.

9. The retransfer printing method in accordance with claim 6, wherein the energy value to be supplied to the thermal head prior to supplying the energy having the first value is designated to heat the thermal head while maintaining a temperature of the thermal head below the lower limit temperature at which the peel functional layer enables to exhibit peeling function when the thermal head is located outside the peeling area.

10. A printing apparatus comprising:

transfer means for transferring a transfer-ink to a transfer layer by heating a thermal head corresponding to an image to be printed so as to form the image composed of the transfer-ink on the transfer layer by way of overlapping an ink ribbon in a belt shape having both layers of a transfer ink layer containing the transfer-ink and a peel functional layer thereon, on an intermediate transfer film in a belt shape having the transfer layer thereon so as to face the transfer ink layer toward the transfer layer, and moving the ink ribbon and the intermediate transfer film together in a longitudinal direction while pressing the thermal head against the back side of the ink ribbon overlapped on the intermediate transfer film;

peel means for peeling off a part of the transfer layer adhered to the peel functional layer from the intermediate transfer film by way of adhering the part of the transfer layer corresponding to a peeling area previously designated within an area of the image to the peel functional layer by heating the thermal head corresponding to the peeling area over a predetermined temperature;

re-transfer means for re-transferring the transfer layer to the printing medium by the thermal transfer method, and resulting in printing the image on the printing medium; and control means for controlling an amount of energy, which is supplied to the thermal head so as to heat the thermal head, in accordance with a location of the thermal head in the peeling area and its neighboring area, wherein energy having a first value is supplied to the thermal head when the thermal head relatively moves from outside the peeling area to inside the peeling area in order to conduct a temperature of the thermal head to reach to a lower limit temperature at which the peel functional layer enables to exhibit peeling function before the thermal head relatively moves from outside the peeling area to inside the peeling area, and wherein energy having a second value is supplied to the thermal head while the thermal head is in the peeling area in order to control a temperature of the thermal head not to exceed a temperature at which the peel functional layer fails to exhibit peeling function and not to fall below the lower limit temperature, and wherein the first value is larger than the second value, and wherein the second value is larger than an energy value that is supplied to the thermal head prior to supplying the energy having the first value.

11. The printing apparatus in accordance with claim 10, wherein the control means controls the amount of energy to be supplied to the thermal head for heating the thermal head in accordance with a shape of a non-transfer area to be formed on the printing medium.

* * * * *